US007823510B1

(12) United States Patent
Hobart et al.

(10) Patent No.: US 7,823,510 B1
(45) Date of Patent: Nov. 2, 2010

(54) EXTENDED RANGE PROJECTILE

(75) Inventors: Stephen Alan Hobart, Huntsville, AL (US); Timothy S. Kokan, Madison, AL (US); Alan B. Minick, Madison, AL (US); Frederic H. Massey, Tullahoma, TN (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 302 days.

(21) Appl. No.: 12/120,345

(22) Filed: May 14, 2008

(51) Int. Cl.
*F42B 12/20* (2006.01)

(52) U.S. Cl. ..... 102/490; 102/440; 102/473; 102/501

(58) Field of Classification Search ..... 102/490, 102/440, 473, 501, 530
See application file for complete search history.

(56) References Cited

U.S. PATENT DOCUMENTS

| | | | | |
|---|---|---|---|---|
| 279,539 | A * | 6/1883 | Chamberlain | 102/375 |
| 412,670 | A | 10/1889 | Ross | |
| 1,243,542 | A | 10/1917 | Moore | |
| 1,277,942 | A | 9/1918 | Kaylor | |
| 1,373,966 | A | 4/1921 | Keyser | |
| 2,027,892 | A | 1/1936 | Williams | |
| 2,090,656 | A | 4/1937 | Williams | |
| 2,090,657 | A | 8/1937 | Williams | |
| 2,176,469 | A | 10/1939 | Moueix | |
| 2,336,146 | A | 8/1944 | Loomis | |
| 2,516,926 | A | 8/1950 | Simpson | |
| 2,579,823 | A | 12/1951 | Homrighous | |
| 2,847,787 | A | 8/1958 | Willams | |
| 2,920,537 | A | 1/1960 | Simmons | |
| 3,018,203 | A | 1/1962 | Guth | |
| 3,125,313 | A | 3/1964 | Soderberg | |
| 3,175,494 | A * | 3/1965 | Turner | 102/440 |
| 3,224,191 | A | 12/1965 | Bratton | |
| 3,282,540 | A | 11/1966 | Lipinski | |
| 3,392,396 | A | 7/1968 | Ehrenspeck | |
| 3,494,285 | A | 2/1970 | Doris, Jr. | |
| 3,547,001 | A | 12/1970 | Stoner | |
| 3,628,457 | A | 12/1971 | Magnusson | |
| 3,698,321 | A | 10/1972 | Wall | |
| 3,754,507 | A | 8/1973 | Dillinger et al. | |
| 3,850,102 | A | 11/1974 | Morrow | |
| 3,860,199 | A | 1/1975 | Dunne | |
| 3,886,009 | A | 5/1975 | Puchalski | |
| 3,951,038 | A | 4/1976 | Van Langenhoven | |

(Continued)

FOREIGN PATENT DOCUMENTS

| | | |
|---|---|---|
| AR | 1373405 | 11/1974 |

(Continued)

OTHER PUBLICATIONS

Small Caliber Ammunition.

(Continued)

*Primary Examiner*—J. Woodrow Eldred
(74) *Attorney, Agent, or Firm*—Carlson, Gaskey & Olds PC

(57) ABSTRACT

A projectile and method of extending the range of the projectile. The projectile includes a storage tank operable to release a working fluid through an exhaust manifold to at least partially fill a wake aft of the projectile during projectile flight.

25 Claims, 8 Drawing Sheets

U.S. PATENT DOCUMENTS 3,961,580 A 6/1976 Burnett et al.
46,490 A 7/1976 Orwig
3,977,629 A 8/1976 Tubeuf
3,988,990 A 11/1976 MacDonald, Jr. et al.
4,003,313 A 1/1977 Puchalski
4,091,732 A 5/1978 Schadow
4,130,061 A 12/1978 Boggs et al.
4,176,487 A 12/1979 Manis
4,176,814 A 12/1979 Albrektsson et al.
4,179,088 A 12/1979 French
4,213,393 A 7/1980 Gunners et al.
4,332,468 A 6/1982 Stiizle
4,379,531 A 4/1983 Manis
4,388,867 A 6/1983 Baumer
4,407,465 A 10/1983 Meyerhoff
4,428,293 A 1/1984 Botwin et al.
4,431,150 A 2/1984 Epperson, Jr.
4,460,137 A 7/1984 Andersson et al.
4,476,785 A 10/1984 Hoffman et al.
4,502,649 A 3/1985 Botwin et al.
4,537,371 A 8/1985 Lawhorn et al.
4,546,940 A 10/1985 Andersson et al.
4,554,872 A 11/1985 Schleicher
4,591,865 A 5/1986 Canal
4,641,802 A 2/1987 Zalmon et al.
4,648,567 A 3/1987 Maudal et al.
4,679,748 A 7/1987 Blomqvist et al.
4,691,633 A 9/1987 Godfrin et al.
4,709,142 A 11/1987 Dahl
4,711,152 A 12/1987 Fortunko
4,712,465 A 12/1987 MacDonald
4,722,261 A 2/1988 Titus
4,726,279 A 2/1988 Kepler et al.
4,733,609 A 3/1988 Goodwin et al.
4,735,148 A 4/1988 Holtzman et al.
4,756,252 A 7/1988 Melhus et al.
4,760,794 A 8/1988 Allen
4,807,532 A 2/1989 Andersson et al.
4,807,535 A 2/1989 Schilling et al.
4,813,635 A 3/1989 Paterson et al.
4,846,071 A 7/1989 Franzen et al.
4,893,815 A 1/1990 Rowan
4,899,956 A 2/1990 King et al.
4,913,029 A 4/1990 Tidman et al.
4,925,129 A 5/1990 Salkeld et al.
4,936,216 A 6/1990 Skagerlund
4,965,453 A 10/1990 Hoschette et al.
4,987,832 A 1/1991 Klink et al.
5,014,621 A 5/1991 Fox et al.
5,056,436 A 10/1991 Greene
5,058,503 A 10/1991 Adams
5,076,053 A 12/1991 McVey et al.
5,099,246 A 3/1992 Skagerlund
5,131,602 A 7/1992 Linick
5,163,637 A 11/1992 Hansen
5,230,656 A 7/1993 Paterson et al.
5,280,751 A 1/1994 Muirhead et al.
5,282,588 A 2/1994 August
5,309,815 A 5/1994 Moller et al.
5,372,334 A 12/1994 Cuadros
5,374,013 A 12/1994 Bassett et al.
5,381,445 A 1/1995 Hershey et al.
5,381,736 A 1/1995 Kalcic
5,414,430 A 5/1995 Hansen
5,419,982 A 5/1995 Tura et al.
5,425,514 A 6/1995 Grosso
5,449,136 A 9/1995 Doria Iriarte
5,455,587 A 10/1995 Schneider
5,529,262 A 6/1996 Horwath
5,529,458 A 6/1996 Humpherson
5,601,255 A 2/1997 Romer et al.
5,647,559 A 7/1997 Romer et al.
5,652,405 A * 7/1997 Rakov ..... 89/7
5,662,291 A 9/1997 Sepp et al.
5,669,581 A 9/1997 Ringer
5,788,178 A 8/1998 Barrett, Jr.
5,798,478 A 8/1998 Beal
5,909,782 A 6/1999 Pluff et al.
5,932,836 A 8/1999 White
6,213,023 B1 * 4/2001 Gunners ..... 102/490
6,230,630 B1 5/2001 Gibson et al.
6,405,653 B1 6/2002 Miskelly
6,422,507 B1 7/2002 Lipeles
6,443,391 B1 9/2002 Malejko et al.
6,474,593 B1 11/2002 Lipeles et al.
6,515,846 B1 2/2003 Tripp
6,608,464 B1 8/2003 Lew et al.
6,615,739 B2 9/2003 Gibson et al.
RE38,261 E 10/2003 White
6,629,669 B2 10/2003 Jensen
6,634,700 B1 10/2003 Calvert
6,655,293 B1 12/2003 Henry et al.
6,727,485 B2 4/2004 Rastegar et al.
6,796,533 B2 9/2004 Barrett et al.
6,799,518 B1 10/2004 Williams
6,805,325 B1 10/2004 Malmuth et al.
6,923,123 B2 8/2005 Rastegar et al.
6,923,404 B1 8/2005 Liu et al.
6,926,345 B2 8/2005 Ortega et al.
6,935,242 B2 8/2005 Rastegar et al.
6,982,402 B1 1/2006 Rastegar et al.
7,002,126 B2 2/2006 Gnemmi et al.
7,079,070 B2 7/2006 Kongelbeck et al.
7,083,141 B2 * 8/2006 Nitenson et al. ..... 244/3.28
7,089,865 B2 8/2006 Regev
7,090,163 B2 8/2006 Rastegar et al.
7,100,514 B2 9/2006 LeBourgeois
7,121,210 B2 10/2006 Steele
7,150,232 B1 12/2006 Rastegar et al.
7,190,304 B1 3/2007 Calson
7,255,044 B2 8/2007 Rastegar et al.
7,255,304 B2 8/2007 Ericson et al.
7,255,387 B2 8/2007 Wood
7,302,773 B2 12/2007 Rozhkov et al.
2003/0056639 A1 3/2003 Giza
2004/0237825 A1 12/2004 Ronn et al.

FOREIGN PATENT DOCUMENTS

DE 1037743 5/1963
FR 510303 2/1920
GB 0147104 7/1920
GB 1221203 2/1971
LU 1286723 8/1972

OTHER PUBLICATIONS

Large-Area Electrostatic-Valved Skins for Adaptive Flow Control on Ornithopter Wings, Liger, Pornsin-Sirirak, Tai, Steve Ho, and Chih-Ming Ho, Solid-State Sensor, Actuator and Microsystems Workshop, Jun. 2-6, 2002, pp. 247-250.
Appendix A, Gun Propulsion Technology, pp. 210-224.
Appendix B, Estimation of Liquid Jet Velocities, pp. 225-232.
Appendix C, Background Theory of Optical Method for Compressible Flows, pp. 233-247.
Appendix D, Shock Wave Theory, pp. 248-259.
Bullet Composition and Characteristics, pp. 1-13.
RDT&E Budget Item Justification Sheet, Feb. 2007, pp. 351-369.
A System-of-Systems Design of a Guided Projectile Mortar Defense System, Kevin Massey, Michael Heiges, Ben Difrancesco, Tommer Ender, and Dimitri Mavris, American Institute of Aeronautics and Astronautics, Inc., pp. 1-16.
Exacto, Lyndall Beamer, DARPO/IXO.

Injection into a Supersonic Stream, EX228, Application Briefs from Fluent.
Guided Bullets: A Decade of Enabling Adaptive Materials R&D, Dr. Ron Barrett, Dr. Gary Lee.
Maximizing Missile Flight Performance, Eugene L. Fleeman, Georgia Institute of Technology.
MScSuite Ammunition Systems 2 Delivery Systems External Ballistics Drag, Dr. Derek Bray, DAPS, pp. 1-37.
Stability Derivatives, Zlatko Petrovic, May 13, 2002, pp. 1-63.
U.S. Appl. No. 12/120,355, filed May 14, 2008, "Guided Projectile".

* cited by examiner

EXTENDED RANGE PROJECTILE

BACKGROUND

The present application relates to projectiles, and more particularly to an extended range non-propulsive projectile.

Conventional non-propulsive projectiles such as bullets, shells, mortars, or other non-propelled aeroshell projectiles are range and terminal energy limited primarily due to the projectiles drag. On a representative projectile, a fore body section generates approximately 65% of the total drag, skin friction generates approximately 5% of the total drag and a base section generates approximately 30% of the total drag. Base drag contributes generally to a relatively large part of the total drag and depends upon the fact that the base pressure due to the resulting wake flow aft of the base section is lower than the ambient air pressure.

Some high velocity projectiles are shape optimized to minimize drag. One such shape optimized projectile includes an aft section shaped to define a reduced diameter or "boat-tail" shape to minimize base drag. Although effective, projectile shape optimization is inherently limited by design objectives of the particular projectile such as mass, payload, and terminal energy.

SUMMARY

A projectile according to an exemplary aspect of the present invention includes: an exhaust manifold defined within a projectile base; and a storage tank operable to release a working fluid through said exhaust manifold to at least partially fill a wake aft of the projectile during projectile flight.

A method of extending the range of a non-propulsive projectile according to an exemplary aspect of the present invention includes: releasing a working fluid from a storage tank contained within a projectile through an exhaust manifold during a flight of the projectile to at least partially fill a wake aft of the projectile.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1:
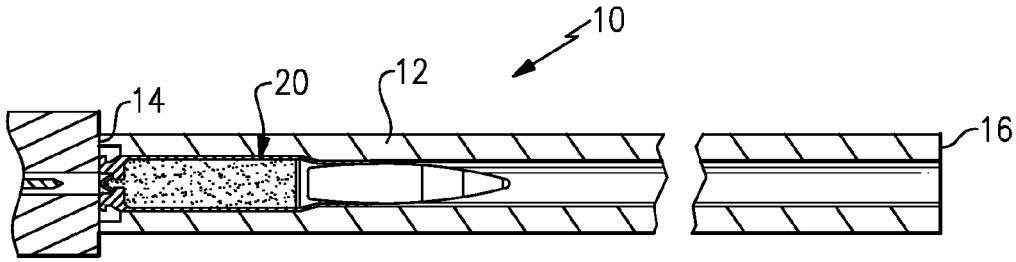
FIG. 1 is a is a partial cut away longitudinal cross-sectional view of an ammunition round including an extended range projectile according to one non-limiting embodiment of the invention chambered in a weapon.

FIG. 1 schematically illustrates an exemplary weapon system 10 which generally includes a barrel 12 which extends from a chamber 14 to a muzzle 16. The barrel 12 extends along a longitudinal axis A and may include a rifled or smooth bore. The illustrated weapon is illustrated in a highly schematic fashion and is not intended to be a precise depiction of an weapon system but is typical of a firearm or cannon which fires an ammunition round 20.

Figure 2:
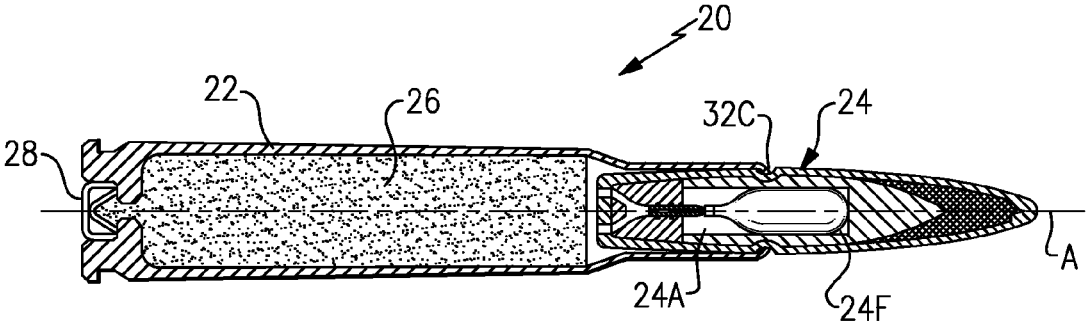
FIG. 2 is a longitudinal section of a round of ammunition.

Referring to FIG. 2, the ammunition round 20 generally includes a cartridge case 22 which fires a non-propulsive projectile 24 with a propellant 26 initiated by a primer 28. The projectile 24 is generally at least partially seated within a mouth of the case 22 such that a projectile aft portion 24A extends at least partially into the case 22 and a forward portion 24F extends out of the case 22 along a longitudinal axis A. Although a particular cased ammunition round typical of a high velocity rifle cartridge such as .50 Caliber (12.7 mm) ammunition is illustrated and described in the disclosed non-limiting embodiment, other configurations including other cased, case-less, bullets, shells, mortars, or other non-propulsive aeroshells fired by various weapon systems will also benefit herefrom.

Figure 3:
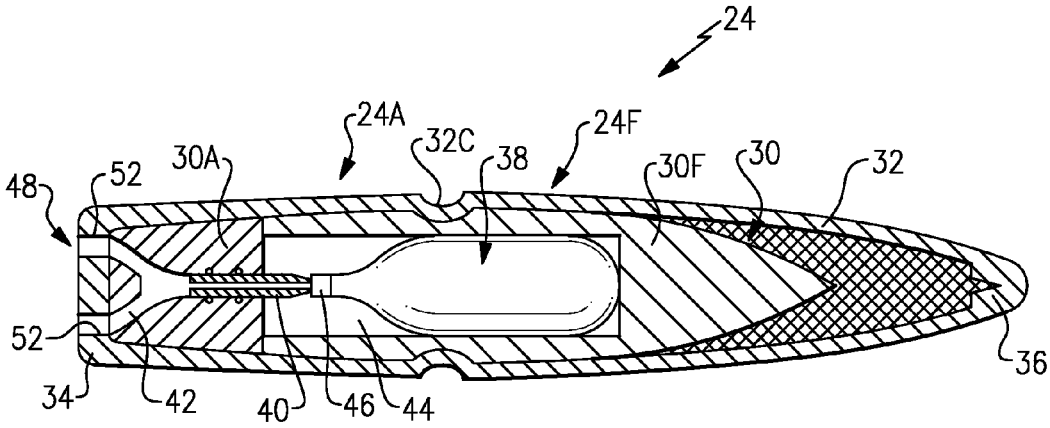
FIG. 3 is a longitudinal section of a projectile according to one non-limiting embodiment of the invention.

Referring to FIG. 3, the projectile 24 generally includes a core 30 surrounded at least in part by a jacket 32. The core 30 is typically manufactured of one or more sections of a relatively heavy material such as lead, steel, tungsten-carbide or other material. That is, the core 30 may include various sections of various metals such as, for example only, an aft lead core section with a forward tungsten-carbide penetrator core section. The jacket 32 is typically manufactured of a gilding metal such as a copper alloy and includes a cannelure 32C at which the projectile 24 is seated within the mouth of the case 22. The location of the cannelure 32C generally defines the aft portion 24A and the forward portion 24F of the projectile 24. The projectile aft portion 24A includes a projectile base 34 and the projectile forward portion 24F includes a nose 36 which may be of a closed tip or open tip design. Although a particular projectile configuration is illustrated and described in the disclosed non-limiting embodiment, other projectile configurations including cased, case-less, bullets, shells, mortars, or other non-propelled aeroshells fired by various weapon systems will also benefit herefrom.

The projectile 24 further includes a storage tank 38, an initiator 40, a distribution manifold 42 and an exhaust manifold 48. The storage tank 38 and the initiator 40 are enclosed within the jacket 32 and may be at least partially retained and positioned within a cavity 44 formed in the core 30. It should also be understood that the disclosure is not restricted to applications where the storage tank 38 is oriented and positioned only as illustrated in the disclosed non-limiting embodiment and that the storage tank 38 may be alternatively oriented and positioned. The distribution manifold 42 provides a communication path for a working fluid such as a compressed gas or liquid contained within the storage tank 38 though the exhaust manifold 48 within projectile base 34 to reduce projectile base drag by wake filling aft of the projectile 24. Whereas the projectile 24 typically includes a multitude of components, the distribution manifold 42 and the exhaust manifold 48 are readily manufactured into one or more of the sections and assembled into the projectile 24. That is, the projectile base 34 may in part be formed by a section of the core 30, the jacket 32 or some combination thereof.

The working fluid in one non-limiting embodiment is of a low molecular weight, a high specific gravity, a low latent heat of vaporization and a low specific heat. Low molecular weight to provide an increased volumetric fill capability per gram of gas or vapor expended. High specific gravity provides a relatively high fluid mass within the available storage volume. Low latent heat of vaporization reduces the fluid temperature drop during expansion and retains the gas volume accordingly. Low specific heat increases the temperature gain during adiabatic compression when the projectile is fired at high G loads. Various combinations of these factors are utilized to establish the working fluid state and characteristics both in the storage tank 38, and in the projectile wake to optimize effectiveness. For example only, a higher fluid temperature resulting in a higher wake fill volume may be achieved by selecting a higher CP propellant when launched at a high G load. Also, a higher temperature when stored within the storage tank 38 may allow use of a higher specific heat working fluid which may cool over the projectile flight but still retain the advantageous thermal properties. Optimization of the extended range capability can be obtained through several various working fluids, some candidates of which are detailed in Table 1:

TABLE 1

| Working fluid | Chemical Symbol | Mol. Weight | Specific Gravity | Latent Heat of Vaporization BTU/lb | Specific Heat (Cp) BTU/LB ° F. | Boiling Point ° F. |
|---|---|---|---|---|---|---|
| Helium | He | 4 | 0.124 | 8.72 | 1.25 | −452.06 |
| Neon | Ne | 20.18 | 1.207 | 37.08 | 0.25 | −244 |
| Xenon | Xe | 131.3 | 3.06 | 41.4 | 0.038 | 14 |
| Krypton | Kr | 83.8 | 2.41 | 46.2 | 0.06 | −76.4 |
| Argon | Ar | 39.95 | 1.4 | 69.8 | 0.125 | −302.6 |
| Nitrogen | N2 | 28.01 | 0.808 | 85.6 | 0.249 | −410.9 |
| Air | — | 28.98 | 0.873 | 88.2 | 0.241 | −317.8 |
| Oxygen | O2 | 32 | 1.14 | 91.7 | 0.2197 | −320.4 |
| Carbon Monoxide | CO | 28.01 | 0.79 | 92.79 | 0.2478 | −312.7 |
| Nitrous Oxide | N2O | 44.01 | 1.53 | 161.8 | 0.206 | −127 |
| Sulfur Dioxide | SO2 | 64.06 | 1.46 | 167.5 | 0.149 | −53.9 |
| Propane | C3H8 | 44.1 | 0.58 | 183.05 | 0.388 | −297.3 |
| Propylene | C3H6 | 42.08 | 0.61 | 188.18 | 0.355 | −43.67 |
| Hydrogen | H2 | 2.02 | 0.071 | 191.7 | 3.425 | −423 |
| Ethylene | C2H4 | 28.05 | 0.567 | 208 | 0.399 | −154.8 |

The working fluid may be stored within the storage tank 38 as a compressed gas or liquid including but not limited to those of Table 1. In one non-limiting embodiment, the working fluid is stored between 5000 psi and 10,000 psi. It should be understand that other pressures commensurate with projectile size and range may alternatively be provided.

Figure 3A:
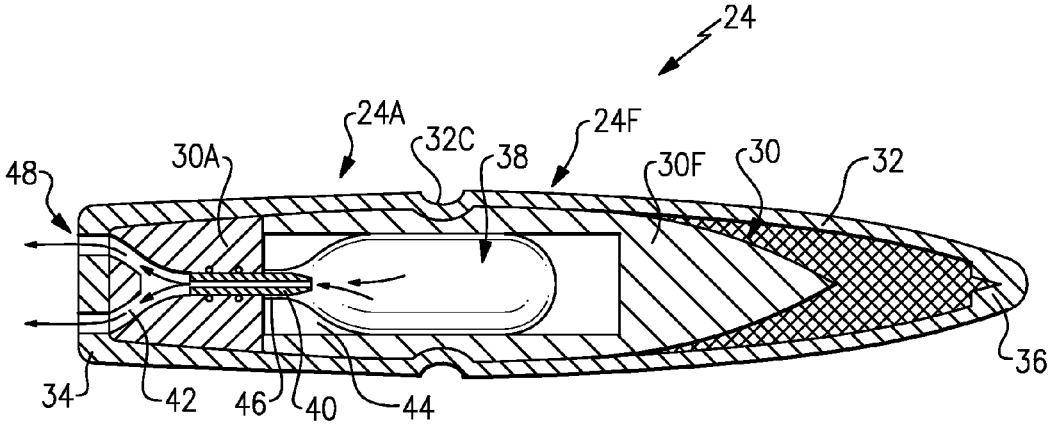
FIG. 3A is a longitudinal section of the projectile of FIG. 3 after an initial acceleration.

The working fluid is released either by the initial acceleration or at a designated time after firing of the projectile 24. In one non-limiting embodiment, the initiator 40 is represented as an acceleration activated relative displacement between the storage tank 38 and the initiator 40 (FIG. 3A). The initiator 40 in this non-limiting embodiment is a hollow punch which penetrates a plug 46 of the storage tank 38 to initiate flow of the working fluid. That is, either or both of the storage tank 38 and the initiator 40 are relatively movable within the cavity 44 in response to firing of the projectile 24. Alternatively, depending on the working fluid selected and the acceleration of the projectile, a burst disk may be used to release the propellant. The burst disk may be activated by acceleration of the working fluid or by pressure increase from adiabatic compression of the working fluid, or by other means as appropriate to the fluid and embodiment selected.

Figure 4:
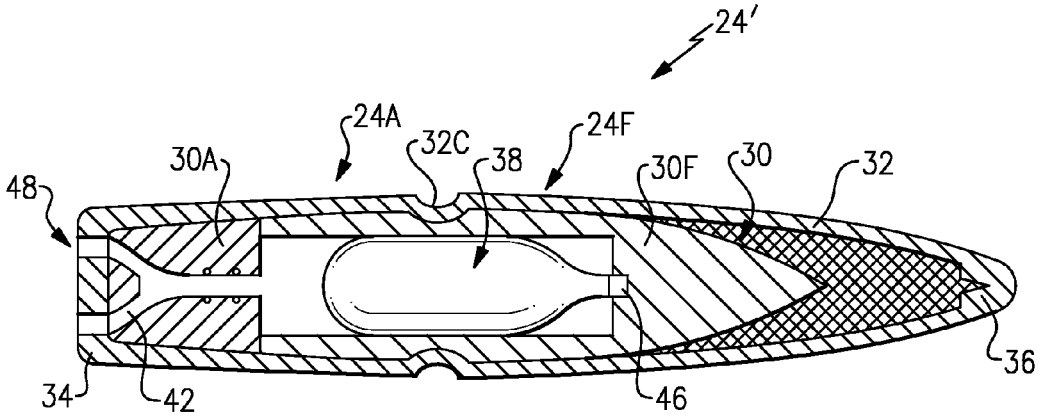
FIG. 4 is a longitudinal section of another projectile according to one non-limiting embodiment of the invention.
Figure 4A:
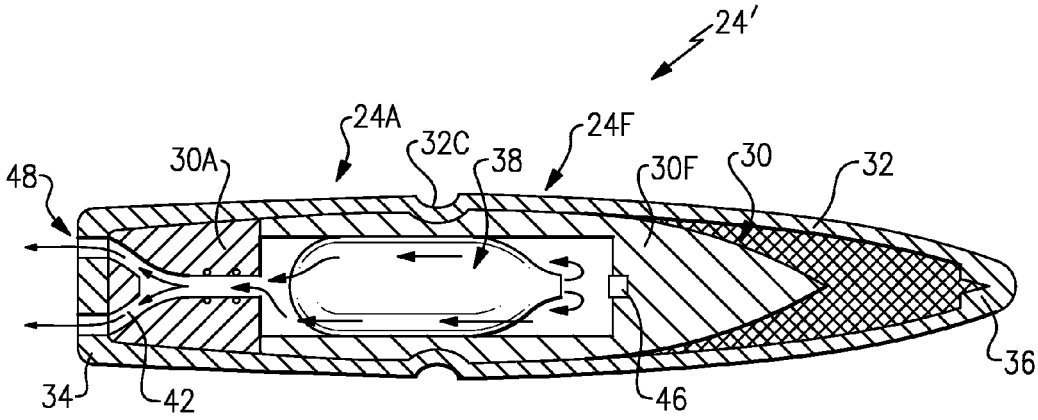
FIG. 4A is a longitudinal section of the projectile of FIG. 3 after an initial acceleration.

Alternatively, the plug 46 is dislodged from the storage tank 38 in response to firing of a projectile 24'. In one non-limiting embodiment, the storage tank 38 is positioned such that the plug 46 is directed toward the nose of the projectile 24' and retained within a forward core portion 30F (FIG. 4). The plug 46 may be bonded crimped, or otherwise retained within the forward core portion 30F such that an initial acceleration of the projectile 24' causes the storage tank 38 to move aft relative to the forward core portion 30F (FIG. 4A) which separates the plug 46 from the storage tank 38 and thereby releases the working fluid. Alternatively, the plug 46 bursts in response to firing without movement of the tank 38 being required.

Figure 5:
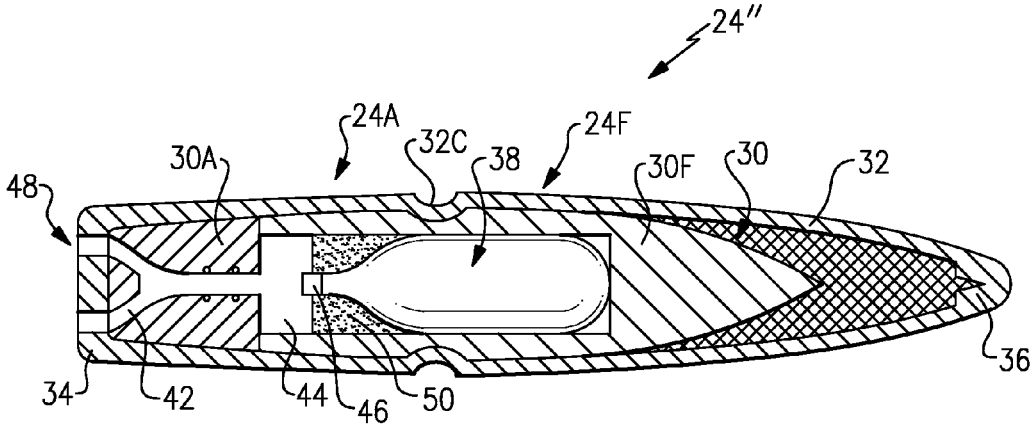
FIG. 5 is a longitudinal section of another projectile according to one non-limiting embodiment of the invention.
Figure 5A:
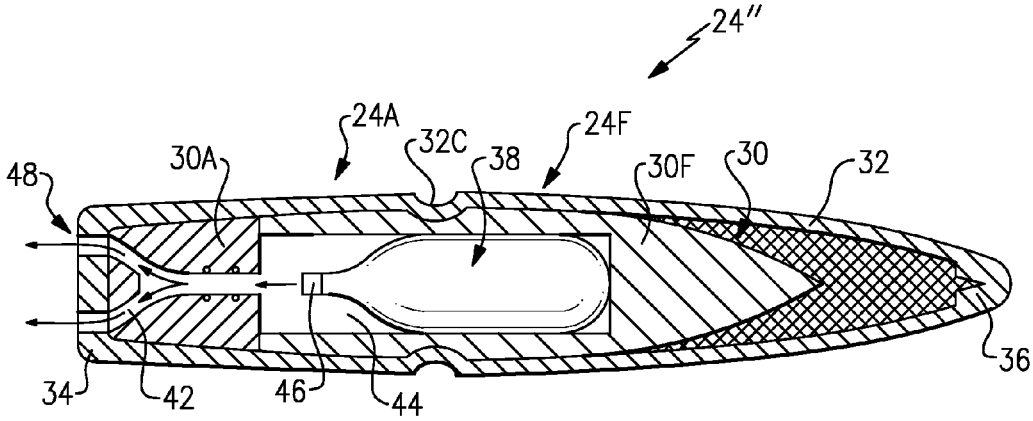
FIG. 5A is a longitudinal section of the projectile of FIG. 3 after an initial acceleration.

Alternatively, the plug 46 is of an electro-mechanical or chemical composition which opens in response to firing of the projectile 24". In one non-limiting embodiment, the propellant 26 (FIG. 2) is communicated into the projectile 24" through the exhaust manifold and distribution manifold 42 when the projectile 24" is fired to essentially burn out the plug 46 (FIGS. 5 and 5A). As the plug 46 may be burned-out, a delay is thereby generated between firing of the projectile 24" and release of the working fluid.

Figure 6:
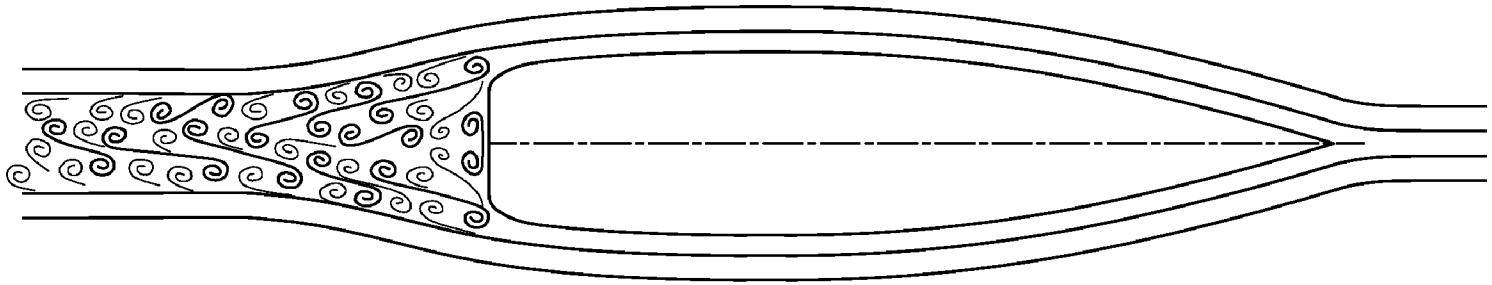
FIG.6 Prior Art
FIG. 6 is a side view of a PRIOR ART conventional projectile which produces a turbulent wake flow.
Figure 7:
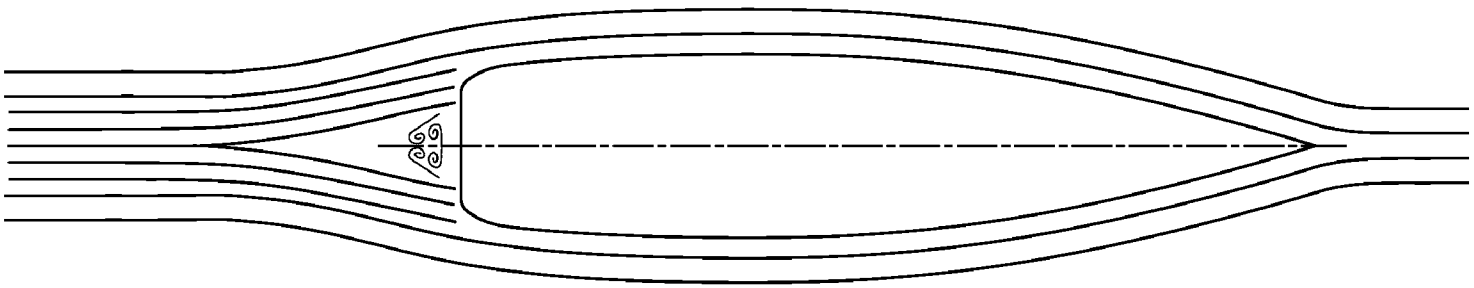
FIG. 7 is a side view of an extended range projectile with wake fill that reduces turbulence and wake drag.

The working fluid flows through the distribution manifold 42 to an exhaust manifold 48 formed in the projectile base 34 to wake fill behind the projectile base and thereby reduce projectile base drag (FIGS. 6 and 7). The working fluid is expanded to approximately one atmospheric pressure or less than one atmospheric pressure though the distribution manifold 42 and exhaust manifold 48 to optimize working fluid utilization. The wake fill may be a full or partial wake fill. Working fluid flow at a generally constant rate may also provide only a partial wake fill at high projectile velocities and a full wake fill at reduced projectile velocities. It should be understood that working fluid expansion need only exceeds the base pressure to extend projectile range. The momentum of the working fluid in accordance with this disclosure is relatively low and therefore the force of reaction on the projectile 24 is negligible as compared to a rocket-type propulsion.

A heat source 50 or other catalytic may additionally be located adjacent the storage tank 38 to increase the temperature of the working fluid (FIG. 5). The heat source 50 may be ignited by the propellant 26 (FIG. 2) which is communicated into the projectile 24 through the exhaust manifold 48 and distribution manifold 42 when the projectile 24 is fired.

Additional sources of heat and/or ignition of the heat source 50 may alternatively or additionally be provided from adiabatic compression and frictional heating as the projectile 24 travels within the barrel 12 (FIG. 1). The propellant 26 may alternatively or additionally cause the working fluid to at least partially combust and increase optimal usage thereof.

Figure 8:
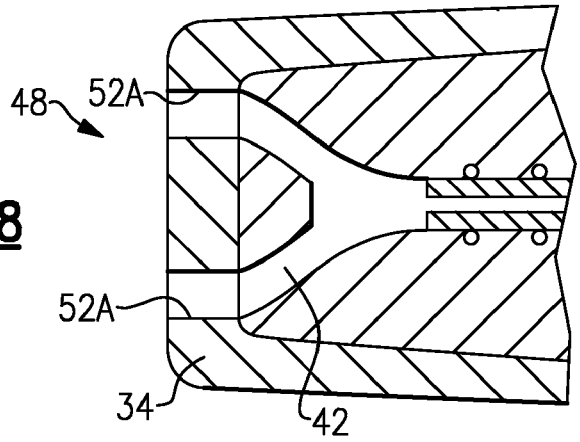
FIG. 8 is an expanded section view of a aft section of a projectile with an aperture type according to one non-limiting embodiment of the invention.
Figure 9:
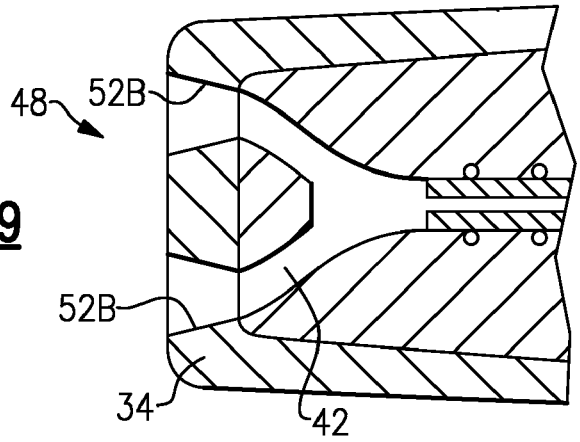
FIG. 9 is an expanded section view of a aft section of a projectile with an aperture type according to another non-limiting embodiment of the invention.
Figure 10:
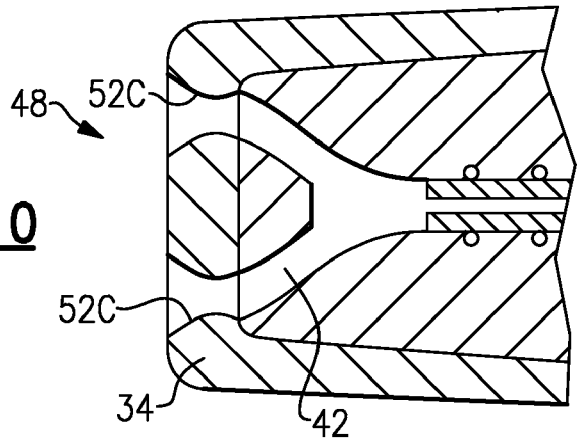
FIG. 10 is an expanded section view of a aft section of a projectile with an aperture type according to another non-limiting embodiment of the invention.

The exhaust manifold 48 may include a multiple of apertures 52 formed through the projectile base 34. In one non-limiting embodiment, the apertures 52A are straight-walled cylindrical holes with an area ratio of one (FIG. 8) which may, for example only, be punch manufactured through the projectile base 34. In another on-limiting embodiment, the apertures 52B are conical shaped (FIG. 9) or the apertures 52C are bell shaped (FIG. 10). Although the apertures 52A are relatively uncomplicated to manufacture relative the apertures 52B or 52C, the apertures 52B, 52C may provide increased performance. Exhaust manifold exit profiles are shown as circular in this non-limiting embodiment but other exit profile may be applied.

Figure 11:
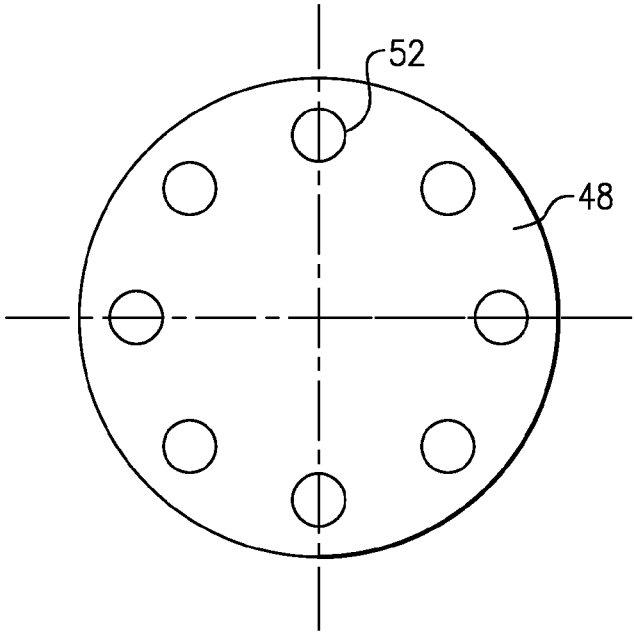
FIG. 11 is a rear view of a projectile with an aperture pattern according to one non-limiting embodiment of the invention.
Figure 12:
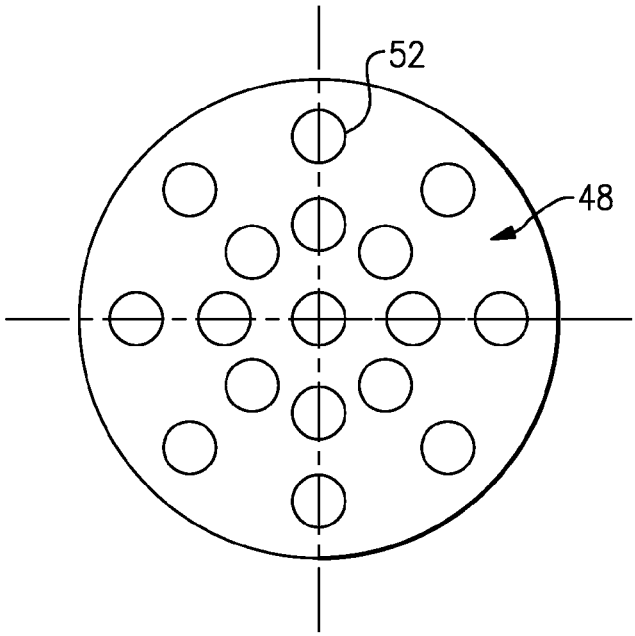
FIG. 12 is a rear view of a projectile with an aperture pattern according to another non-limiting embodiment of the invention.

The distribution manifold 42 facilitates an arrangement of apertures 52 into a desired pattern. The apertures 52 may be arranged in a ring pattern (FIG. 11), showerhead pattern (FIG. 12) or other pattern to provide a desired wake fill.

Referring to FIG. 7, wake fill reduces turbulence and wake drag relative a conventional projectile which generates a turbulent wake (FIG. 6). The wake fill can reduce the total projectile drag up to 30% and increase the effective range by up to 50%, increase projectile velocity relative to distance, and thereby extend projectile range. Increased energy versus distance and increases the effective impact of the projectile even at standard ranges.

For a given working fluid flow, the completeness of wake filling will increase as the projectile velocity decreases. Because of this characteristic, delay of the wake fill initiation may extend the range further than wake fill initiated upon launch. The wake fill may be delayed through an eroding throat formed into the distribution manifold 42 and/or the apertures 52. Utilization of a differential eroding throat within each aperture 52 or pattern of apertures 52 facilitates a wake fill pattern which changes during the projectile 24 flight.

Figure 13:
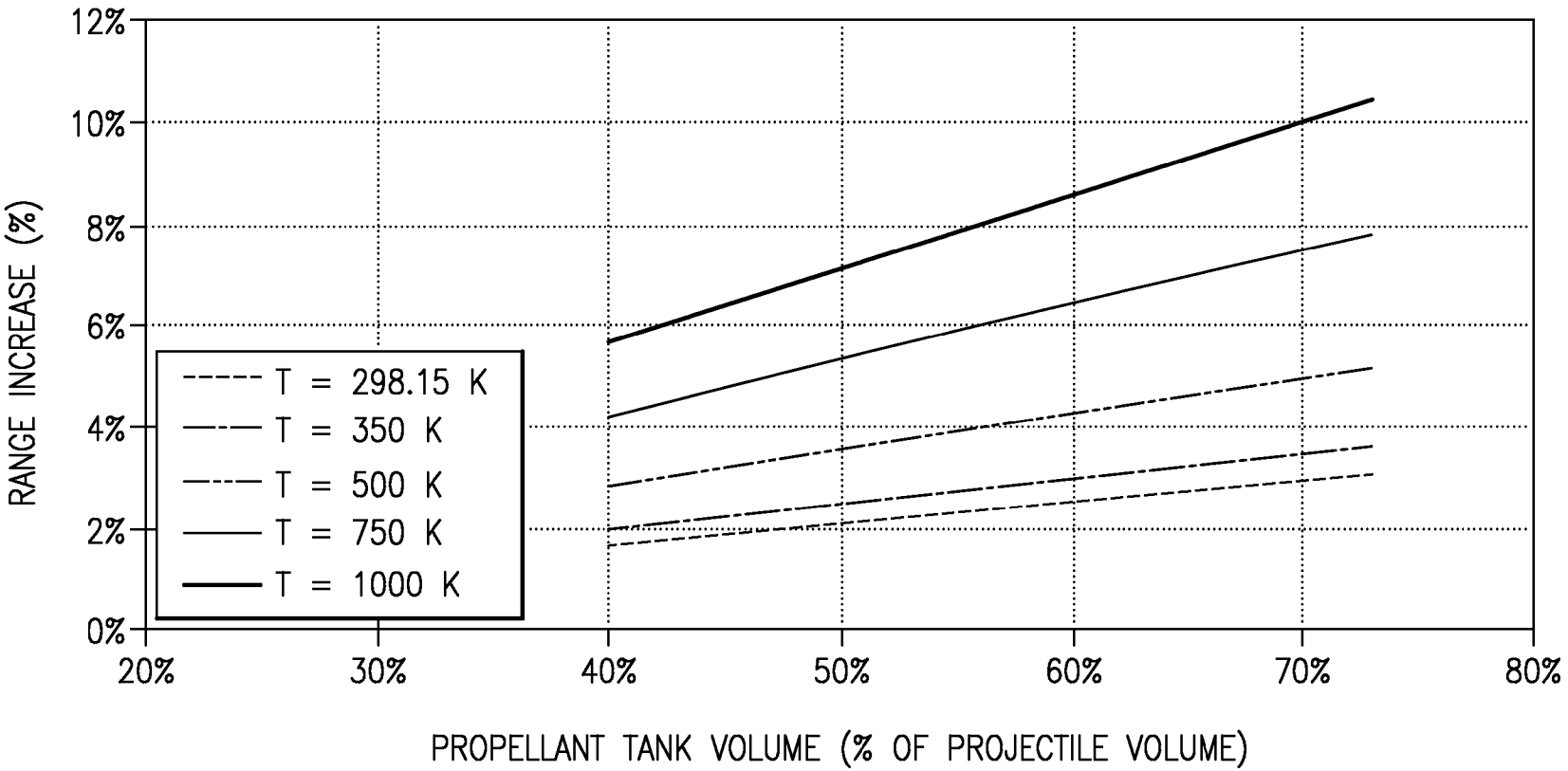
FIG. 13 is a graph of a comparison between a conventional projectile speed vs distance relative an enhanced range projectile with wake fill.

Referring to FIG. 13, the storage tank 38 capacity available within the projective determines the resultant range extension with nitrous oxide as the working fluid. The range extension is expressed as a proportion of the total projectile mass, with a projectile aspect ratio of approximately 11 to 1. The effectiveness of the working fluid fill will increase approximately linear with higher aspect ratio and reduce with reduction of the aspect ratio. As illustrated, increased working fluid storage capacity is related to range extension. Other factors which may affect range extension includes working fluid utilization effectiveness as controlled by the working fluid properties (temperature and density) and nozzle effectiveness.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A projectile comprising:

a projectile base;

an exhaust manifold defined within said projectile base; and an initiator operable to release a working fluid from a storage tank in response to an acceleration of the projectile, the working fluid released through said exhaust manifold to at least partially fill a wake aft of the projectile during projectile flight.

2. The projectile as recited in claim 1, wherein said exhaust manifold comprises an aperture.

3. The projectile as recited in claim 2, wherein said aperture comprises a nozzle.

4. The projectile as recited in claim 1, wherein said exhaust manifold comprises a multiple of apertures.

5. The projectile as recited in claim 4, wherein said multiple of apertures defines a ring pattern.

6. The projectile as recited in claim 4, wherein said multiple of apertures defines a showerhead pattern with a multiple of rings.

7. The projectile as recited in claim 1, further comprising a core contained at least partially within a jacket, said core defines a cavity which contains said storage tank.

8. The projectile as recited in claim 1, further comprising a distribution manifold between said storage tank and said exhaust manifold.

9. A projectile comprising:

a projectile base;

an exhaust manifold defined within said projectile base;

a storage tank operable to release a working fluid through said exhaust manifold to at least partially fill a wake aft of the projectile during projectile flight; and an initiator adjacent said storage tank, at lest one of said initiator and said storage tank relatively movable to the other of said initiator and said storage tank to release the working fluid from said storage tank in response to an acceleration of the projectile.

10. A projectile comprising:

a projectile base;

an exhaust manifold defined within said projectile base;

a storage tank operable to release a working fluid through said exhaust manifold to at least partially fill a wake aft of the projectile during projectile flight; and a plug which seals said storage tank, said plug dislodgeable from said storage tank to release the working fluid from said storage tank in response to an acceleration of the projectile.

11. A projectile comprising:

a projectile base;

an exhaust manifold defined within said projectile base;

a storage tank operable to release a working fluid through said exhaust manifold to at least partially fill a wake aft of the projectile during projectile flight; and a plug which seals said storage tank, said plug opens to release the working fluid from said storage tank in response to an acceleration of the projectile.

12. A projectile comprising:

a projectile base;

an exhaust manifold defined within said projectile base;

a storage tank operable to release a working fluid through said exhaust manifold to at least partially fill a wake aft of the projectile during projectile flight; and an initiator which activates upon initial acceleration of the projectile to release the working fluid.

13. A projectile comprising:

a projectile base;

an exhaust manifold defined within said projectile base; and a storage tank operable to release a working fluid through said exhaust manifold to at least partially fill a wake aft of the projectile during projectile flight; and an initiator which activates at a predetermined time after initial acceleration of the projectile to release the working fluid.

14. A projectile comprising:

a projectile base;

an exhaust manifold defined within said projectile base; and a storage tank operable to release a working fluid through said exhaust manifold to at least partially fill a wake aft of the projectile during projectile flight; and a heat source adjacent said storage tank, said heat source operable to increase the temperature of the working fluid upon initial acceleration of the projectile.

15. A round of ammunition comprising:

a cartridge case;

a projectile seated within said cartridge case, said projectiles having a projectile base;

an exhaust manifold defined within said projectile base; and a storage tank operable to release a working fluid through said exhaust manifold to at least partially fill a wake aft of the projectile during projectile flight; and an initiator operable to release the working fluid from said storage tank in response to an acceleration of the projectile.

16. The round of ammunition as recited in claim 15, wherein said projectile further comprises:

a core which defines a cavity which contains said storage tank; and a jacket which surrounds said core, said jacket defines a cannelure at which said cartridge case is crimped to said projectile.

17. A method of extending the range of a non-propulsive projectile comprising:

activating an initiator to release a working fluid from a storage tank contained within a projectile in response to an acceleration of the projectile, the working fluid released through an exhaust manifold during a flight of the projectile to at least partially fill a wake aft of the projectile.

18. A method of extending the range of a non-propulsive projectile comprising:

releasing a working fluid at a predetermined time after firing of the projectile from a cartridge case from a storage tank contained within a projectile through an exhaust manifold during a flight of the projectile to at least partially fill a wake aft of the projectile.

19. A method as recited in claim 17, further comprising releasing the working fluid upon firing of the projectile from a cartridge case.

20. A method of extending the range of a non-propulsive projectile comprising:

releasing a working fluid from a storage tank contained within a cavity of a projectile through an exhaust manifold during a flight of the projectile to at least partially fill a wake aft of the projectile, the storage tank movable within the cavity to initiate release of the working fluid.

21. A method as recited in claim 17, wherein at least partially filling the wake aft of the projectile reduces projectile base drag.

22. A method as recited in claim 17, further comprising:

expanding the working fluid at a pressure which exceeds a base pressure of the projectile.

23. A method as recited in claim 17, further comprising:

expanding the working fluid to below approximately one atmospheric pressure though the exhaust manifold.

24. A method as recited in claim 17, further comprising:

expanding the working fluid to below approximately one atmospheric pressure though the exhaust manifold.

25. The projectile as recited in claim 1, wherein said working fluid is stored above 5000 psi.

* * * * *